US005379979A

United States Patent [19]

Due

[11] Patent Number: 5,379,979

[45] Date of Patent: Jan. 10, 1995

[54] DEVICE FOR SUPPORTING RING BINDERS

[76] Inventor: Joern Due, Rugmarken 63, DK-9670 Loegstoer, Denmark

[21] Appl. No.: 133,173

[22] PCT Filed: May 5, 1992

[86] PCT No.: PCT/DK92/00145

§ 371 Date: Oct. 25, 1993

§ 102(e) Date: Oct. 25, 1993

[87] PCT Pub. No.: WO92/19459

PCT Pub. Date: Nov. 12, 1992

[51] Int. Cl.[6] ..... A47B 19/00

[52] U.S. Cl. ..... 248/441.1; 281/45

[58] Field of Search ..... 248/441.1, 459, 460, 248/450; 281/45

[56] References Cited

U.S. PATENT DOCUMENTS

| | | | |
|---|---|---|---|
| 1,720,607 | 7/1929 | Reed | 281/45 X |
| 1,908,874 | 5/1933 | Alstine | 248/441.1 X |
| 2,159,921 | 5/1939 | Welk et al. . | |
| 2,921,402 | 1/1960 | Trick . | |
| 3,502,295 | 3/1970 | Sganga | 248/459 |
| 4,173,358 | 11/1979 | Wilson | 281/45 |
| 4,575,037 | 3/1986 | Hammar | 248/441.1 |
| 4,687,226 | 8/1987 | Rose . | |
| 4,709,895 | 12/1987 | Mardak | 248/459 X |
| 4,793,633 | 12/1988 | Rose . | |
| 4,807,906 | 2/1989 | Seaver | 248/460 X |
| 5,022,170 | 6/1991 | House | 281/45 X |
| 5,230,535 | 7/1993 | Figlenski | 248/441.1 X |

FOREIGN PATENT DOCUMENTS

| | | | |
|---|---|---|---|
| 87906 | 9/1952 | Netherlands | 281/45 |
| 348068 | 8/1972 | Sweden . | |

*Primary Examiner*—J. Franklin Foss

*Attorney, Agent, or Firm*—Watson, Cole, Grindle & Watson

[57] ABSTRACT

A device (2) for supporting ring binders (12) in a position where the spine (16) of the ring binder faces upwards, includes grooves (1a. 1b), in which the edge areas (15) farthest from the spine (16) provided with rings (17) of a ring binder (12) are placed. These grooves (1a. 1b) are provided with a wider width than the thickness of the ring binder cover (13, 14). The device (2) has also at least one supporting plate (8) for supporting the ring binder cover (13, 14). The groove (1a, 1b) design allows easy and quick positioning of the ring binder (12) in or removal of it from the device (2), and the ring binder (12) may be shifted sideways, when it is placed in the device (2). The supporting plate (8) ensures that it is possible to write in the ring binder (12) when it is placed in the device (2) irrespective of the degree of stiffness of the ring binder cover (13, 14). At the same time, the supporting plate (8) acts as a guide, so the ring binder (12) may readily be positioned in the grooves (1a, 1b).

10 Claims, 1 Drawing Sheet

DEVICE FOR SUPPORTING RING BINDERS

BACKGROUND OF THE INVENTION

The present invention relates to a device for supporting ring binders in a position where the spine of the ring binder faces upwards with at least one of the ring binder covers disposed at an angle of between 30° and 90° relative to its horizontal orientation. The ring binder may either be ordinary file ring binders or calendar ring binders and calendar note pad ring binders.

Devices of this type for different sorts of readings, e.g. display cards, books and the like, are known. They are produced in many embodiments according to the intended purpose.

Devices which are intended for supporting ring binders and the like in their open state are also known.

For book displays in libraries, e.g. a device is known comprising an element with a first supporting surface for the cover of the book directed slantingly upwards at an angle of between 30° and 90° relative to its horizontal orientation, and with a second supporting surface for the edge of the book directed slantingly outwards and which is, in size, substantially smaller than the first surface. This element is supported in a suitable manner. This device is not intended for securing a book or a ring binder in its open state, as the poor securing of the cover does not ensure that the book or ring binder stays open or that the book or the ring binder does not fall from the device during use.

With calendars, a principle is often used according to which loose leaves are kept together by means of a ring element attached to a surface on which the leaves of the calendar rest. This surface is often slanted in order to increase the readability when the calendar is placed at a distance from the user, e.g. at the far end of the table opposite the user. In said principle, the calendar leaves and the ring element become an integrated part of the calendar leaf holder. This may be disadvantageous, as thus the calendar cannot be taken out of the holder and used elsewhere.

U.S. Pat. No. 1,914,016 discloses a holder for books and the like, comprising a frame with a number of fixed and resilient lips displaced relative to each other across the frame and positioned in front of and behind the frame, thereby forming V-shaped clamps for securing the cover of a book or the like. This holder does not allow easy and quick positioning of the ring binder in or removal of it from the holder, neither is it possible to displace easily the ring binder sideways in the holder.

In SE Patent Specification No. 348,068, a holder for books, brochures, etc., is described comprising a bottom part with a plane surface, and from this surface two lips are provided at each end which are oriented upwards and inwards towards the center of said bottom part, and a top part comprising two surfaces forming a V-shaped resilient element which is faced upside down and placed in the bottom part, whereby the resilient effect secures clamping of the ring binder between the top part and the upwardly directed lips. According to this principle, not only the cover is secured, but also the sheets in the ring binder and this is a major disadvantage which does not allow for the flipping of sheets in the ring binder placed in the holder.

It is the object of the present invention to provide a device for supporting a ring binder, in which the said disadvantages are remedied, and which has a larger field of application. Moreover, it is the object to make it possible to write in the ring binder while it is placed in the holder irrespective of the degree of stiffness of the ring binder cover.

These objects are obtained with the device according to the invention, which is characterized in that the device comprises a bottom plate which is provided with two grooves that are made to engage with the edge areas farthest away from the ring spine of a ring binder, and the width of which is a little wider than the thickness of the cover, the length of which is greater than the cover, and the depth of which is so designed that the edges of the sheets of the ring binder, when this is placed in the device do not touch the bottom plate.

For the device, it will be possible to produce the grooves so that they engage accurately with the edge areas of the ring binder in a manner that can be compared to a loose fit. Hereby, the two grooves secure that the angle between the foremost and the hindmost covers of the ring binder is maintained, when their edge areas fit into the two grooves. This mutual angle is also maintained when the sheet contents of the ring binder are flipped from side to side. Thus, the device constitutes a solid writing support, in which the one surface that faces the user will always have a fixed angle as defined by the angle of the grooves.

Thereby, it will be possible easily and quickly to place the ring binder in or remove it from the device, so that e.g. calendars placed in the device may easily be taken out and used elsewhere and later be replaced in the device for use with same.

According to an advantageous embodiment, the device comprises at least one element which extends upwards from the groove for support of the cover surface in at least one point.

BRIEF DESCRIPTION OF THE DRAWING

The invention will now be further explained with reference to the accompanying drawing, wherein

FIG. 1 shows a ring binder 12 placed in a device 2 according to the invention. The ring binder 12 has a relatively stiff foremost and hindmost cover 13,14. The device 2 is provided with grooves 1*a*, 1*b* which will be explained later. In FIG. 1, the ring binder 12 is shown in a position to the left in grooves 1*a*, 1*b*. The device 2 in the embodiment shown is produced in one piece, preferably of a plastic material, and consists of a bottom plate 11 which has a profiled edge 3,6 along its circumference to form a so-called notions tray. Each of the two profiled side edges 6 comprises one of the grooves 1*a*, 1*b*. The grooves are of such a depth, that they engage with a substantial part of the edge areas 15 (see FIG. 3) of the cover, which face away from the spine 16 of the ring binder 12, which is provided with rings 17 that support the leaves 18 of the ring binder 12. It is noted that the grooves 1*a*, 1*b* are wider than the thickness of the cover, so that a fixed clamping of the ring binder is avoided, but nevertheless a stable positioning of the ring binder in the device is accomplished.

Figure 1:
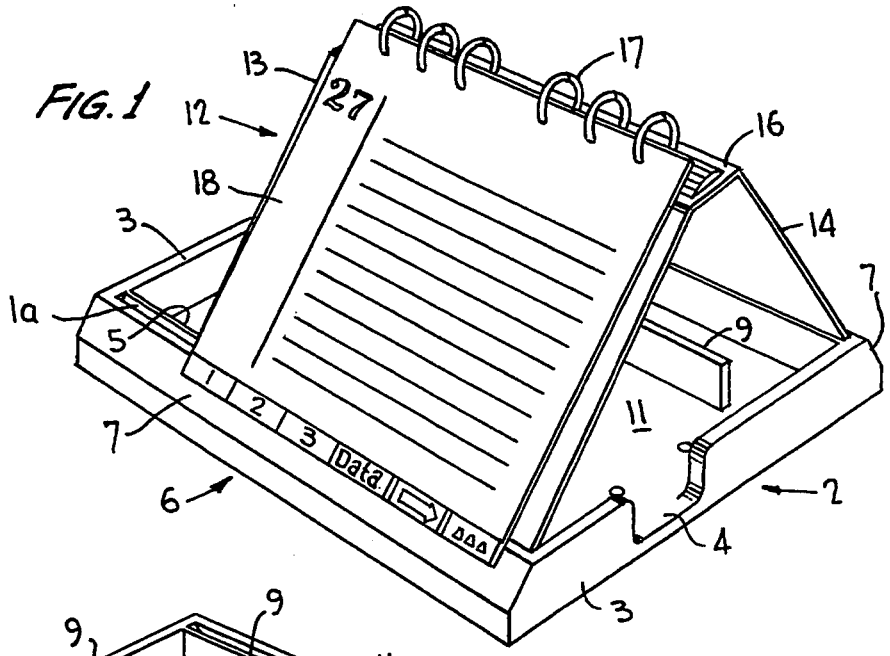
FIG. 1 is a perspective view of the device for supporting ring binders with the ring binder placed in the device.

The profiled edges 3 constitutes both the end parts of the grooves 1*a*, 1*b* and the sides of the notions tray. The profiled edges 6 form the other sides of the notions tray which contain the grooves 1*a*, 1*b* which are delimited by inwardly facing side walls 5 and outwardly facing side walls 7. The one raised edge 3 is provided with a cut-out 4, thereby facilitating the user's access to leaves of note paper (not shown) which may be placed in the tray.

In the embodiment shown, the grooves 1*a*, 1*b* are longer than the height of the cover 13,14 of the ring binder. Hereby, the ring binder 12 may be displaced in the grooves 1*a*, 1*b*, so that there is ready access to paper clips, etc., in the one or the other side of the tray. Alternatively, the length of the grooves may substantially correspond to the height of the cover.

The outwardly facing side walls 7 of the grooves are comprised of or are provided with a transparent plate, in which or on which an information carrier may be placed, e.g. a label with company name, address, telephone number or a clock. Alternatively, such a transparent plate may expose an information carrier on the cover of the ring binder.

Figure 2:
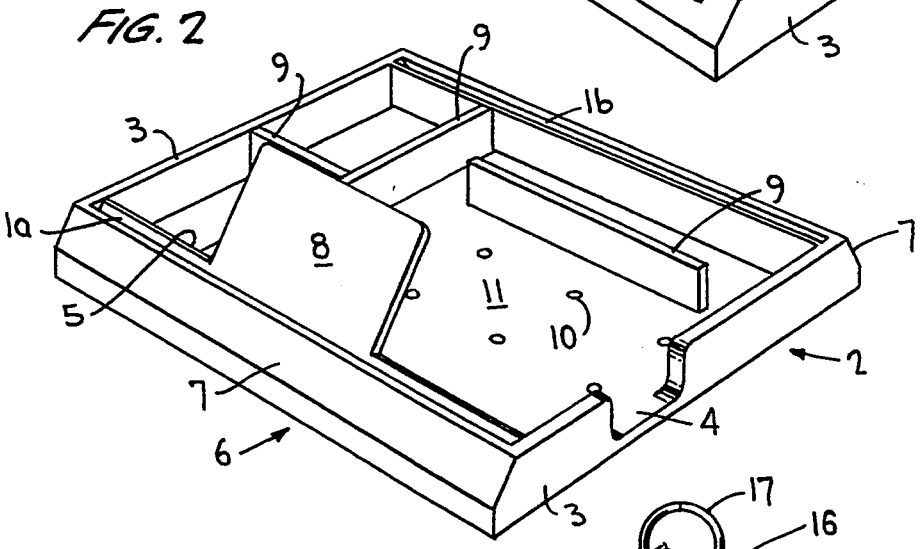
FIG. 2 is a perspective view of the device shown in FIG. 1 without the ring binder.

FIG. 2 shows the device 2 with a supporting plate 8 and partition walls 9 for the formation of compartments individually adapted to the items to be contained in said compartments, e.g. paper clips, pens, note pads, etc. The bottom plate 11 is provided with holes 10 and the partition walls 9 are provided with small pivots {not shown} which in size and mutual distance are adapted to the holes 10 in the bottom plate 11. Thus, the partition walls 9 may be placed at liberty according to the needs of the individual user for the division into compartments of the notions tray.

Figure 3:
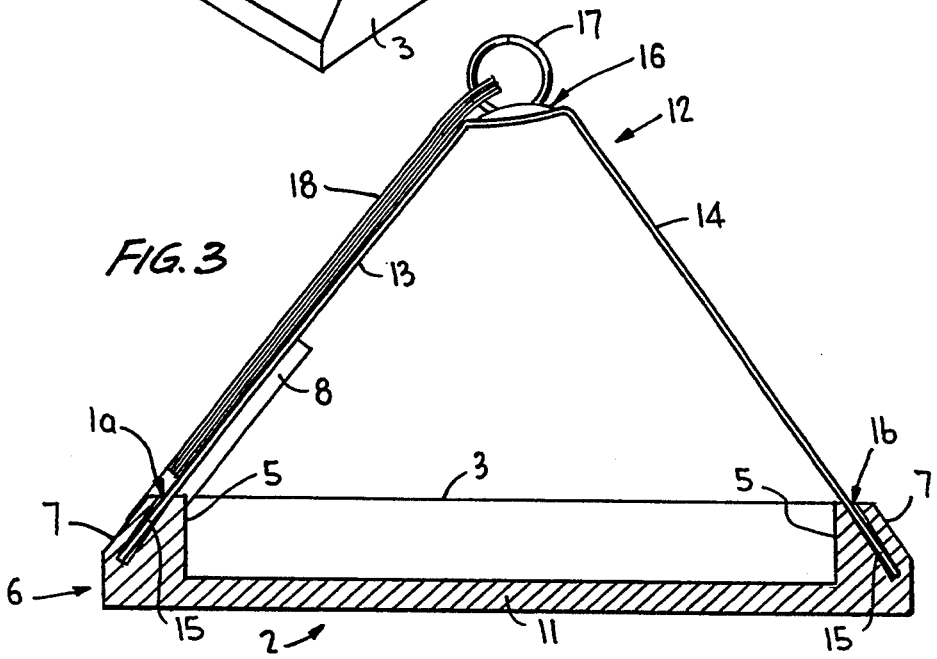
FIG. 3 is a sectional view through the device shown in FIG. 1.

FIG. 3 shows the ring binder placed in the grooves 1*a*, 1*b* with the foremost cover 13 supported by the supporting plate 8. Hereby, the support of the ring binder will be more stable than when supported merely by the edge areas 15, and it will be easier to write in the ring binder when it is placed in the device. The supporting plate 8 supports all or a part of the ring binder cover, thus making no requirements to the stiffness of the cover for writing in the ring binder. The supporting plate 8 may either be produced separately and mounted on the bottom plate 11 and grooves 1*a*, 1*b* by means of the pivots, dove-tail grooves or the like, or it may be produced integral with the foremost inwardly facing side wall 5 of the foremost groove. The first said embodiment may prove advantageous in the packing and sending operations of the device, in which the supporting plate 8 may be placed inside the raised edges 3,6 of the device. The supporting plate 8 may also act as a guide during positioning of the ring binder cover in the grooves. Therefore, the device may advantageously be provided with another supporting plate (not shown), which is placed laterally reversed at the hindmost groove 1*b*.

The device is suitable for many uses, preferably in offices, but also in private homes, at workshops etc.

I claim:

1. Device for supporting ring binders in a position where the spine of the ring binder faces upwards with at least one of the ring binder covers disposed at an angle of between 30° and 90° relative to its horizontal orientation, wherein the device comprises a bottom plate which is provided with two grooves that are made to engage with the edge areas farthest away from the ring spine of a ring binder, the width of each of said grooves being defined by opposed side walls spaced apart a distance slightly greater than the thickness of the cover, the length of each of said grooves being greater than the cover, and the depth of each of said grooves being so designed that the edges of the sheets of the ring binder, when the ring binder is placed in the device, do not contact the bottom plate.

2. Device according to claim 1, wherein the device comprises at least one element which extends upwards from one of the grooves for supporting the surface of the cover in at least one point.

3. Device according to claim 2, wherein the element comprises a surface which is plane with one of the sidewalls of said one groove, and which forms a supporting surface for at least one of the ring binder covers.

4. Device according to claim 1, wherein the bottom plate is provided with holders for the formation of compartments in the bottom plate to contain office supplies such as pens, note pads, paper clips and the like.

5. Device according to claim 1, wherein the grooves are provided with end parts and that these end parts extend across the bottom plate and also form the sides in a tray of which the other sides are formed by the side wall of the grooves.

6. Device according to claim 1, wherein the bottom plate has a plane underside provided with a non-skid coating.

7. Device according to claim 4, wherein the bottom plate is plane and provided with a punched pattern in which the elements of the wall may be placed at liberty for the formation of individually adapted compartments.

8. Device according to claim 5, wherein the end parts are provided with outwardly facing holes for containing penholders.

9. Device according to claim 1, wherein the groove has at least one outwardly facing side wall which is from a transparent material.

10. Device according to claim 9, wherein said outwardly facing side wall of the groove comprises an information carrier.

* * * * *